US005099250A

United States Patent [19]

Paulus et al.

[11] Patent Number: 5,099,250

[45] Date of Patent: Mar. 24, 1992

[54] MOTOR-VEHICLE WINDSHIELD WITH BUILT-IN ANTENNA/HEATING CONDUCTORS

[75] Inventors: Peter Paulus, Münster; Paul Weigt; Hans-Jürgen Niklewski, both of Bochum, all of Fed. Rep. of Germany

[73] Assignee: Flachglas Aktiengesellschaft, Furth, Fed. Rep. of Germany

[21] Appl. No.: 522,888

[22] Filed: May 14, 1990

[30] Foreign Application Priority Data

Jun. 1, 1989 [DE] Fed. Rep. of Germany ..... 3917829

[51] Int. Cl.[5] ..... H01Q 001/320; H01Q 001/020

[52] U.S. Cl. ..... 343/704; 343/713

[58] Field of Search ..... 343/704, 713, 711, 712, 343/850, 857

[56] References Cited

U.S. PATENT DOCUMENTS

| | | | |
|---|---|---|---|
| 3,945,014 | 3/1976 | Kunert et al. | 343/713 |
| 4,331,961 | 5/1982 | Davis | 343/704 |
| 4,491,844 | 1/1985 | Tsuchie et al. | 343/704 |

FOREIGN PATENT DOCUMENTS

| | | | |
|---|---|---|---|
| 3820229 | 11/1989 | Fed. Rep. of Germany . | |
| 0024802 | 3/1981 | Japan | 343/713 |

*Primary Examiner*—Michael C. Wimer
*Assistant Examiner*—Peter Toby Brown
*Attorney, Agent, or Firm*—Herbert Dubno; Andrew Wilford

[57] ABSTRACT

A windshield has a generally upright transparent panel, an array of horizontal and generally parallel heater conductors on the panel and having opposite ends, and respective conductive busses connected to the heater conductors at the opposite ends thereof. Thus electricity can be applied to the busses to pass current through the heater conductors and thereby heat the panel at the array. A pair of generally upright, generally parallel, and horizontally spaced antenna conductors on the panel extend across and connect at crossing locations to the heater conductors and an output conductor is connected electrically to the antenna conductors so that radio-frequency output is taken off the output conductor. The crossing locations of each of the antenna conductors are all located at points of the same potential on the respective heater conductors and the only direct electrical connection between the pair of antenna conductors is through the heater conductors. The output conductor can be connected to one of the heater conductors and therethrough to the antenna conductors. It can also be connected directly to one of the antenna conductors and indirectly via a nonresistive impedance to the other antenna conductor. This nonresistive impedance can be a capacitor or an inductor. It is also possible to connect both the antenna conductors via such a nonresistive impedance to the output conductor.

7 Claims, 2 Drawing Sheets

MOTOR-VEHICLE WINDSHIELD WITH BUILT-IN ANTENNA/HEATING CONDUCTORS

FIELD OF THE INVENTION

The present invention relates to a motor-vehicle window panel. More particularly this invention concerns a rear windshield with built-in heating and antenna conductors.

BACKGROUND OF THE INVENTION

It is standard to provide a motor-vehicle window, typically the rear one, with conductors through which electricity is passed to heat the glass panel, thereby eliminating condensation and ice. These conductors are normally provided as an array of horizontal and parallel lines of conductive paint applied to or imbedded in the window panel which itself can be of tempered glass or laminated safety glass. The ends of the parallel conductors are connected to vertically running bus connectors that are in turn connected to the on-board direct-current electrical system.

In recent times it has become common practice to incorporate the radio antenna in the windshield so as to make it vandal proof and to lower costs. In order to pick up vertically as well as horizontally polarized signals, at least two parallel but horizontally spaced vertical antenna conductors are provided that extend across and connect to several of the heater conductors and that are in turn connected to an antenna-output conductor. The radio-frequency output can be taken off the feed busses for the heater conductors also. Normally the vertical crosswise antenna conductors extend up past the array of horizontal heater conductors where they are connected to output conductors.

Such antenna systems often provide adequate reception, but their presence causes some degradation in performance of the window heater. In effect the crosswise antenna conductors provide low-resistance shunts for the current in the heater so that in the critical central region where the vertical antenna conductors are provided, heating is irregular, leaving uncleared spots on the windshield.

OBJECTS OF THE INVENTION

It is therefore an object of the present invention to provide an improved combined heater/antenna system for a windshield.

Another object is the provision of such an improved combined heater/antenna system for a windshield which overcomes the above-given disadvantages, that is whose antenna performance is good and which provides uniform heating over the entire conductor array.

SUMMARY OF THE INVENTION

A windshield has a generally upright transparent panel, an array of horizontal and generally parallel heater conductors on the panel and having opposite ends, and respective conductive busses connected to the heater conductors at the opposite ends thereof. Thus electricity can be applied to the busses to pass current through the heater conductors and thereby heat the panel at the array. A pair of generally upright, generally parallel, and horizontally spaced antenna conductors on the panel extend across and connect at crossing locations to the heater conductors and an output conductor is connected electrically to the antenna conductors so that radio-frequency output is taken off the output conductor. According to this invention the crossing locations of each of the antenna conductors are all located at points of the same potential on the respective heater conductors and the only direct electrical connection between the pair of antenna conductors is through the heater conductors. The term "direct" here is intended to cover a low-resistance electrical connection, as opposed to an "indirect" connection which can be capacitive, inductive, or have a high-resistance impedance.

Thus there will be no flow of current other than the tiny r-f signals that are picked up through the antenna conductors. All the connection locations for each antenna conductor are at the same potential so such flow is possible. Finding these equipotential locations is fairly simple, normally a simple question of measuring the rectified length of each heater conductor, it being noted that windshields are invariably curved so that the parallel conductors are of different lengths, and connecting each antenna conductor at a location on each conductor corresponding to the same percentage of the respective heating conductor's length, presuming of course that the heater conductors are of uniform resistance. This means, of course, that on anything other than a perfectly rectangular array on a perfectly planar windshield panel the antenna conductors will not be straight, but will normally follow some sort of curve corresponding to the curvature of the panel.

According to another feature of this invention the output conductor is connected to one of the heater conductors and therethrough to the antenna conductors. This is the simplest arrangement. Normally the output conductor is connected to the one heater conductor equidistant between the antenna conductors.

In accordance with a further feature of the invention the output conductor is connected directly to one of the antenna conductors and indirectly via a nonresistive impedance to the other antenna conductor. This nonresistive impedance can be a capacitor or an inductor. It is also possible to connect both the antenna conductors via such a nonresistive impedance to the output conductor. This further decouples the antenna from the heater, while still adequately transmitting radio-frequency signals.

DESCRIPTION OF THE DRAWING

The above and other objects, features, and advantages will become more readily apparent from the following, reference being made to the accompanying drawing in which.

SPECIFIC DESCRIPTION

Figure 1:
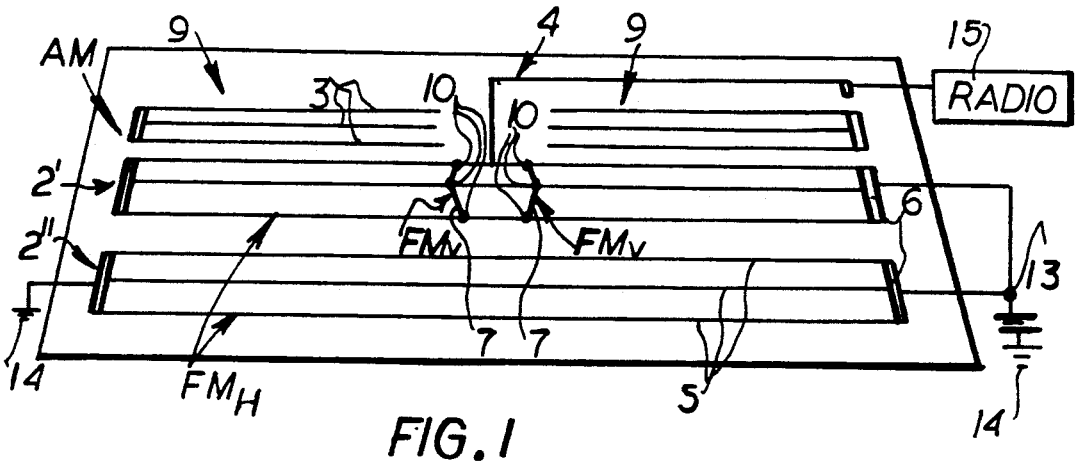
FIG. 1 is a partly diagrammatic representation of the windshield and associated elements according to this invention.
Figure 2:
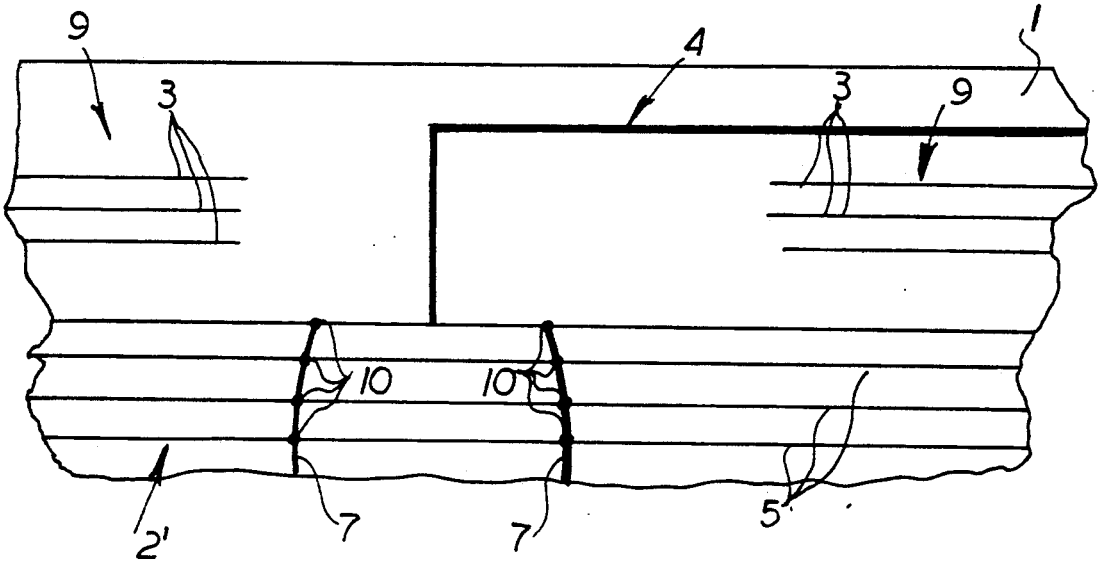
FIG. 2 is a large-scale view of a detail of a windshield like that of FIG 1.

As seen in FIGS. 1 and 2 a rear-windshield 1 according to this invention is provided with upper and lower heater arrays 2' and 2'' and, above these arrays 2' and 2'', with further antenna arrays 9 of conductors 3. An antenna-output conductor 4 is applied to the windshield panel 1 above the arrays 2' and 2'' and between the two arrays 9 and in turn is connected to the vehicle radio 15.

Each of the arrays 2' and 2" is formed by a plurality of horizontally extending and parallel conductive strips 5 normally painted on the inside surface of the panel 1 and connected at opposite ends to busses 6. One of each of the busses 6 of each array 2' and 2" is connected to the hot side of the onboard power supply 13 and the other is connected to a ground 14. Thus current can flow through the conductors 5 to heat the panel 1 and thereby eliminate condensation and ice thereon.

According to this invention, the conductors 5 of the upper array are connected at 10 to two separate antenna conductors 7 that extend generally vertically, and the output conductor 4 is connected to the uppermost conductor 5 of the array 2' at a point equidistant between the upper two locations 10. The locations 10 of each antenna conductor 7 are at points of the same potential relative to ground so that there will be no flow of the heating current through the antenna conductors 7. These points 10 are determined empirically and depend in large part on the shape of the panel 1, which rarely is planar.

The antenna conductors 3 form an amplitude-modulation antenna AM, the conductors 7 a frequency-modulation antenna $FM_V$ for vertically polarized frequency-modulated signals, and the conductors 5 an antenna $FM_H$ for horizontally polarized frequency-modulated signals. The antenna system AM can also be used in a so-called diversity system for receiving some frequency-modulated signals.

Figure 3:
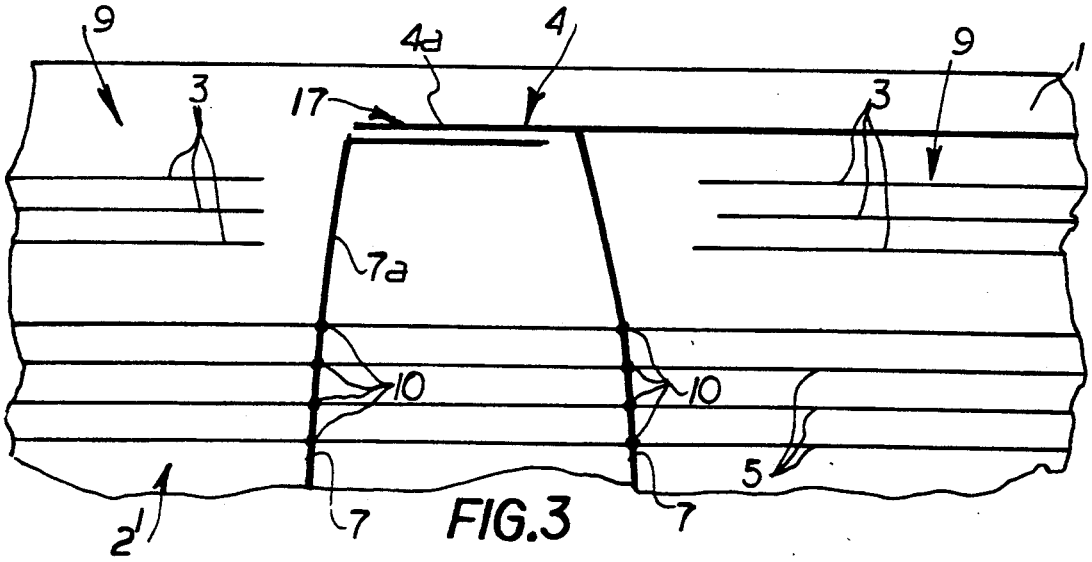
FIGS. 3, 4, 5, and 6 are views like FIG. 2 but showing alternative arrangements in accordance with this invention.
Figure 4:
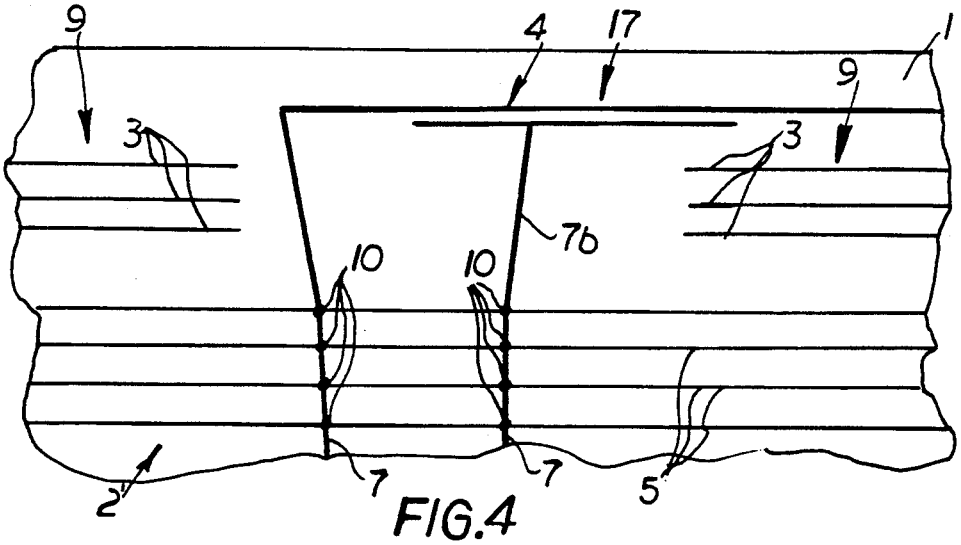

FIG. 3 shows an arrangement wherein one of the conductors 7 is connected directly to the output conductor 4 and the other is extended at 7*a* to run parallel to an extension 4*a* of the conductor 4 to form a capacitor 17 therewith. The system of FIG. 4 is identical in effect, but the other conductor is extended as a T at 7*b* to be juxtaposed with and form a capacitor 17 with the conductor 4.

Figure 5:
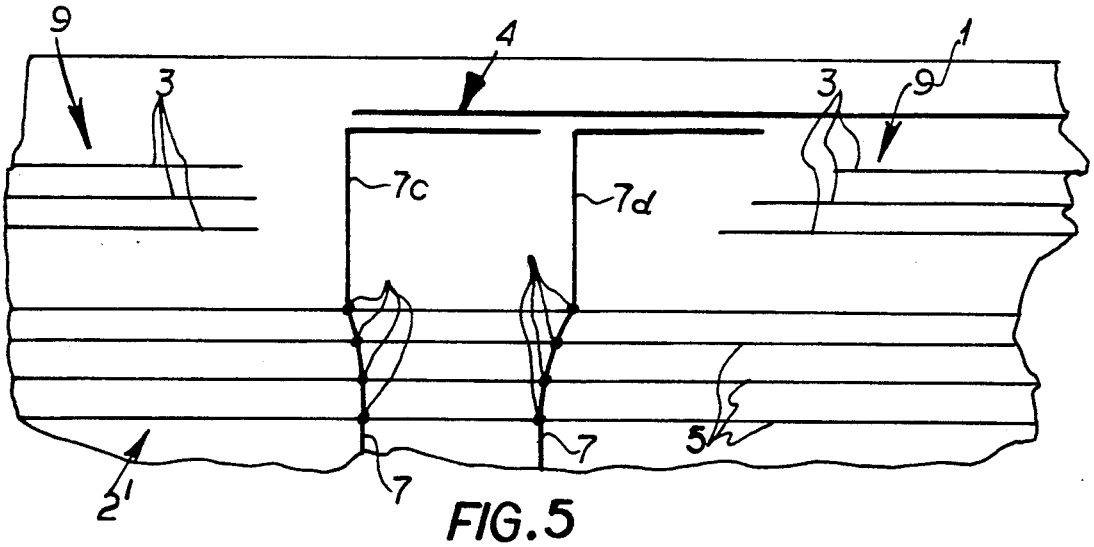

In FIG. 5 the conductors 7 have extensions 7*c* and 7*d* that both form an indirect, here capacitive connection with the conductor 4.

Figure 6:
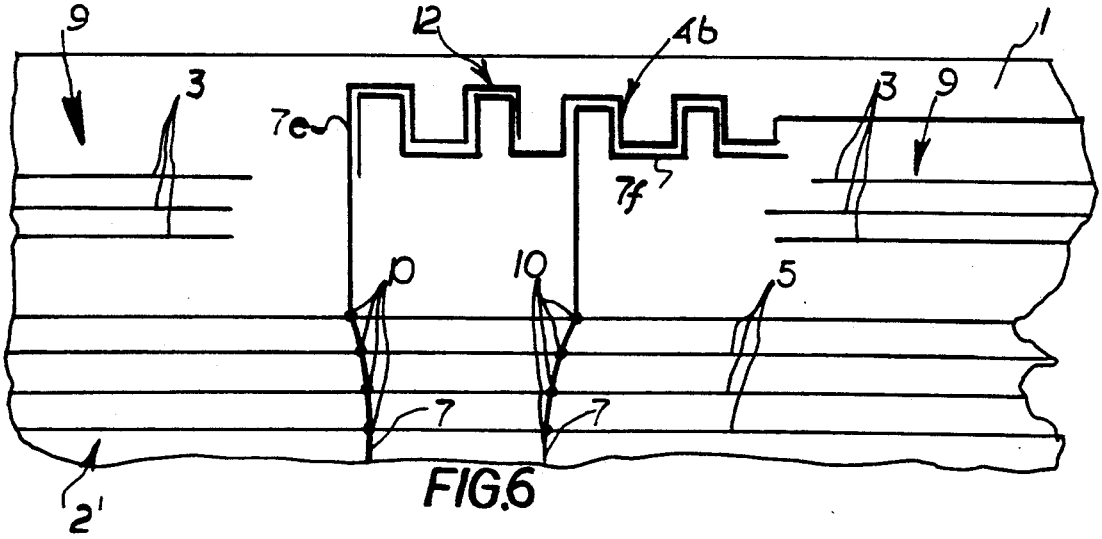

The system of FIG. 6 has a meandering end section 4*b* on the output line 4 that is juxtaposed by meander extensions 7*e* and 7*f* of the antenna lines 7 so as to form combined inductive/capacitive connections 12.

We claim:

1. In a windshield comprising:

a generally upright transparent panel;

an array of horizontal and generally parallel heater conductors on the panel and having opposite ends;

respective conductive busses connected to the heater conductors at the opposite ends thereof, whereby electricity can be applied to the busses to pass current through the heater conductors and thereby heat the panel at the array;

a plurality of generally upright, generally parallel, and horizontally spaced antenna conductors on the panel within the heater-conductor array and extending across and directly connected at crossing locations to the heater conductors; and an output conductor on the panel connected electrically to the antenna conductors, whereby radio-frequency output is taken off the output conductor, the improvement wherein the crossing locations of each of the antenna conductors are all located at points that are offset from the busses on the respective heater conductors and that are of the same potential on the respective heater conductors; and the only direct electrical connection between the plurality of antenna conductors is through the heater conductors.

2. The windshield defined in claim 1 wherein the output conductor is connected to one of the heater conductors and via the one heater conductor to the antenna conductors.

3. The windshield defined in claim 2 wherein the output conductor is connected to the one heater conductor equidistant between the antenna conductors.

4. The windshield defined in claim 1 wherein the output conductor is connected directly to one of the antenna conductors and is connected indirectly via a nonrestrictive impedance to a selected other of the antenna conductors.

5. The windshield defined in claim 4 wherein the output conductor and the selected other of the antenna conductors are spacedly juxtaposed to form the nonrestrictive impedance.

6. The windshield defined in claim 1 wherein the output conductor is shaped as a meander line and the antenna conductors are provided with respective meandering conductors flanking and parallel to the meander line and forming a nonrestrictive connection therewith.

7. The windshield defined in claim 1 wherein the antenna conductors are provided with connection conductors extending parallel to but not touching the output conductor to form capacitive connections therewith.

* * * * *